United States Patent [19]

Coupe et al.

[11] Patent Number: 4,829,231

[45] Date of Patent: May 9, 1989

[54] CURRENT MIRROR HAVING A HIGH OUTPUT VOLTAGE

[75] Inventors: Jean-Denis Coupe, Forges les Eaux; Marc Ryat, Vieil Brioude; Philippe Raguet, Cormelles le Royal; Jean-Paul Bardyn, Marcq en Baroeul, all of France

[73] Assignee: U.S. Philips Corp., New York, N.Y.

[21] Appl. No.: 184,321

[22] Filed: Apr. 21, 1988

[30] Foreign Application Priority Data

May 22, 1987 [FR] France ..... 87 07218

[51] Int. Cl.[4] ..... G05F 3/16

[52] U.S. Cl. ..... 323/315; 323/312

[58] Field of Search ..... 323/312, 315, 316, 317

[56] References Cited

U.S. PATENT DOCUMENTS 4,081,696 3/1978 Oda et al. ..... 323/315

4,471,236 9/1984 Patterson ..... 323/315

*Primary Examiner*—Patrick R. Salce

*Assistant Examiner*—Jeffrey Sterrett

*Attorney, Agent, or Firm*—Bernard Franzblau

[57] ABSTRACT

A current mirror that comprises a first branch which includes the series arrangement of a diode ($D_1$) and the main current path of a transistor ($T_1$), and a second branch comprising the series arrangement of the main current path of a transistor ($T_2$) and a diode ($D_2$). In order to increase the voltage Vs available at the current mirror output, a diode ($D_3$) is connected in the first branch and a transistor ($T_3$) is connected in the second branch. One electrode of the diode ($D_3$) is connected to the base of a transistor ($T_4$), whose collector receives a supply voltage (U) and whose emitter is connected to the base of the transistor ($T_2$). The base of the transistor ($T_1$) is connected to one electrode of the diode ($D_2$) and to the emitter of the transistor ($T_2$). A diode ($D_4$) is poled in the forward direction between the power-supply source U and the base of the transistor ($T_3$). A diode Z, is poled in the reverse direction, is connected between the base of the transistor ($T_3$) and the emitter of the transistor ($T_2$) to allow the transistor $T_3$ to be operated in the $B_{VCBO}$ mode when the diode is conductive.

2 Claims, 1 Drawing Sheet

CURRENT MIRROR HAVING A HIGH OUTPUT VOLTAGE

BACKGROUND OF THE INVENTION

This invention relates to a current mirror which comprises a first branch for receiving an input current to be reproduced and comprising the series arrangement of a first diode poled in the forward direction and the main-current path of a first transistor whose emitter is connected to a common-mode terminal, and a second branch for supplying an output current which is a replica of said input current and comprising the series arrangement of the main current path of a second transistor and a second diode which is poled in the forward direction and which has a first electrode connected to the base of the first transistor and to the emitter of the second transistor and which has a second electrode connected to the common-mode terminal.

Such a current mirror, in which the first electrode of the first diode is connected to the base of the second transistor, is referred to as a "WILSON-type current mirror". The output voltage which can be delivered by such a current mirror is limited because an accurate replica of the input current is obtained only when the second transistor does not operate in the avalanche-breakdown region.

SUMMARY OF THE INVENTION

It is an object of the invention to provide a current mirror whose output current is a highly accurate replica of the input current for substantially higher output voltages.

To this end a current mirror in accordance with the invention is characterized in that the first branch comprises a third diode arranged in series and poled in the forward direction and having a first electrode for receiving the input current to be reproduced, in that the second branch comprises the main current path of a third transistor whose emitter is connected to the collector of the second transistor and whose collector supplies the output current, and a diode poled in the reverse direction between the base of the third transistor and the emitter of the second transistor, in that it comprises a fourth diode, placed in the forward direction and having a first electrode connected to a power-supply terminal and a second electrode connected to the base of the third transistor, and a fourth transistor whose base is connected to the first electrode of the third diode, whose collector is connected to said power-supply terminal, and whose emitter is connected to the base of the second transistor.

BRIEF DESCRIPTION OF THE DRAWINGS

Embodiments of the invention will now be described in more detail, by way of example, with reference to the accompanying drawings, in which.

DESCRIPTION OF THE PREFERRED EMBODIMENT

Figure 1:
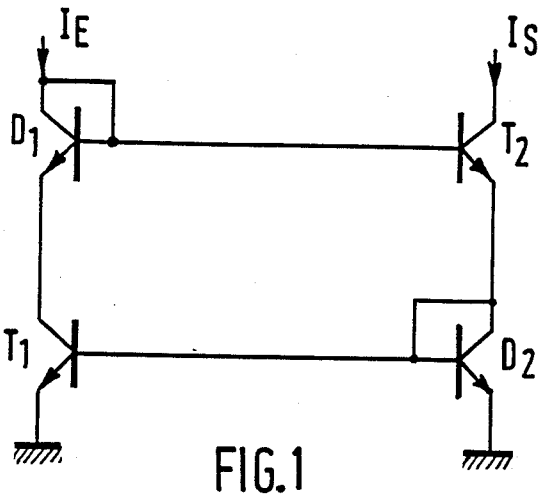
FIG. 1 shows a prior-art current mirror of the WILSON type.

In FIG. 1 a WILSON-type current mirror comprises an input branch, receiving an input current $I_E$ and comprising the main current path of a transistor $T_1$, and an output branch, in which an output current $I_s$ flows and which comprises the main current path of a transistor $T_2$. Moreover, in series with said main current path of the transistor $T_1$, the first branch comprises a diode $D_1$, which is poled in the forward direction and in the present case comprises an npn transistor whose base and collector are short-circuited and connected to the base of the transistor $T_2$ and whose emitter is connected to the collector of the transistor $T_1$, which has its emitter connected to the common-mode terminal.

Moreover, in series with the main current path of the transistor $T_2$, the second branch comprises a diode $D_2$, which is poled in the forward direction and in the present case comprises an npn transistor whose base and collector are short-circuited and connected to the base of the transistor $T_1$ and to the emitter of the transistor $T_2$ and whose emitter is connected to the common-mode terminal. $I_{b1}$ and $I_{b2}$ are the base currents of the transistors $T_1$ and $T_2$ respectively.

The current applied to the collector of $T_1$ has a value $I_E-I_{b2}$, so that the current in the emitter of $T_1$ has a value $I_E-I_{b2}+I_{b1}$. Since the base of the transistor $T_1$ and the anode of the diode $D_2$ are interconnected, the last-mentioned current is equal to the current flowing in the diode $D_2$ if this diode comprises a diode-connected transistor of the same dimensions as the transistor $T_1$.

The current flowing on the emitter of the transistor $T_2$ consequently has the value $I_E-I_{b2}+2I_{b1}$, so that:

$$I_s=I_E+2(I_{b1}-I_{b2})=I_E.$$

However, as a result of the structure of the output branch the maximum output voltage which can be obtained on the collector of the transistor $T_2$ is limited to a value of the order of magnitude of $B_{VCEO}+V_{BE}$, because when the collector-emitter voltage of $T_2$ reaches th value $B_{VCEO}$ its operation is no longer linear (avalanche-breakdown region) and Is is only an approximation to $I_E$.

In general, it is desirable that the reproduction accuracy be of the order of a few %, which means that the arrangement must be redesigned if output voltages higher than $B_{VCEO}$ are required.

The basic idea of the invention is to allow operation in the region of $B_{VCB}$ by turning on a diode which injects a negative base current into a transistor of the second branch.

Figure 2:
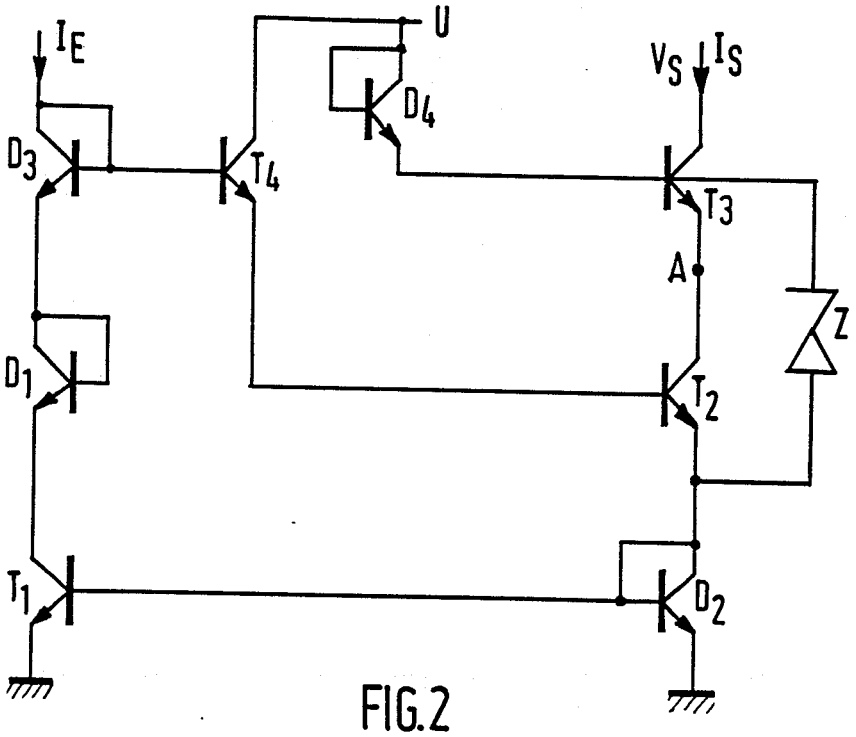
FIG. 2 shows a current mirror in accordance with the invention.

FIG. 2 shows how this can be achieved by means of npn transistors.

The first branch comprises, in series and in this order, a transistor $D_3$ which is connected as a diode by short-circuiting its base and its collector to each other, its collector receiving the input current $I_E$, a diode-connected transistor $D_1$ whose base and collector are short-circuited to each other and are connected to the emitter of $D_3$, and a transistor $T_1$, having its collector connected to the emitter of $D_1$ and having its emitter connected to ground.

The second branch comprises, in series and in this order, a transistor $T_3$, whose collector supplies the output current Is which is a replica of the input current $I_e$ and whose emitter is connected (point A) to the collector of a transistor $T_2$ having its emitter connected to the interconnected base and collector of a diode-connected transistor $D_2$ whose emitter is connected to ground. The base and the collector of $D_2$ are also connected to the base of the transistor $T_1$.

The second branch also comprises at least one diode poled in the reverse direction, for example a Zener diode, arranged between the base of the transistor $T_3$ and the emitter of the transistor $T_2$. The base of the transistor $T_2$ is connected to the emitter of a transistor $T_4$ having its collector connected to a voltage source U and having its base connected to the interconnected collector and base of $D_3$. A diode-connected transistor $D_4$, whose base and collector are short-circuited to each other and are connected to the power-supply source U, has its emitter connected to the base of the transistor $T_3$.

U is the supply voltage and $V_{BE}$ is the emitter-base voltage of a transistor (approximately 0.7 V). Vs is the output voltage on the collector of the transistor $T_3$. Three ranges of operation are distinguished.

(1) $Vs > U - 2V_{BE} + B_{VCEO}(T_3)$ $B_{VCEO}(T_3)$ is the avalanche-breakdown voltage of the transistor $T_3$. The voltage $V_A$ on point A is constant and is equal to:

$$V_A = U - 2V_{BE}$$

because the collector-emitter voltage VCE ($T_3$) is smaller than $B_{VCEO}(T_3)$.

The voltage across the diode Z is also equal to $U - 2V_{BE}$.

If the Zener voltage $V_Z$ of the diode Z is higher than $U - 2V_{BE}$, the diode Z is cut off and the current mirror operates in the customary manner.

Then, $Is = I_E$ if the base current of the transistor $T_4$ is ignored, which current is approximately $I_E/\beta 2$, $\beta$ being the current gain of a transistor.

(2) $Vs > U - 2V_{BE} + B_{VCEO}(T_3)$ and $Vs < V_Z + B_{VCEO}(T_3) + V_{BE}$.

This yields:

$$V_{CE}(T_3) = B_{VCEO}(T_3).$$

The base current of $T_3$, $I_b(T_3)$, is cancelled out and the voltage $V_A$ follows Vs:

$$VA = Vs - B_{VCEO}(T_3).$$

The voltage across the diode Z is approximately $Vs - B_{VCEO}(T_3) - V_{BE}$ and consequently remains smaller than $V_Z$, which means that the diode Z remains cut off. Thus: $Is = I_E + I_B$ because $I_B(T_3) = 0$ (3) $Vs > V_Z + B_{VCEO}(T_3) + V_{BE}$ The diode Z becomes conductive. A current $I_B(T_3) < 0$ can flow and the transistor $T_3$ begins to operate in the region of $B_{VCB}$.

The current is through the collector-base junction of the transistor $T_3$ and the diode Z increases as the output voltage Vs increases.

The output current Is tends to become $I_E + 2I_B$.

The maximum value of Vs is either $B_{VCBO}(T_3) + V_Z + V_{BE}$ or the collector substrate breakdown voltage of the transistor $T_3$ if this voltage is smaller.

It is to be noted that Vz must be such that the $BV_{CEO}$ of the transistor $T_2$ is not reached.

EXAMPLE $B_{VCEO}$ = 27 V $B_{VCBO}$ = 67 V $B_{VCS}$ = 72 V
$V_Z$ = 7.2 V U = 3 V $I_E$ = 100 μA

| Vs(V) | 2 | 3 | 4 | 10 | 20 | 30 | 40 | 50 | 60 | 70 | 72 |
|---|---|---|---|---|---|---|---|---|---|---|---|
| Is(μa) | 98.65 | 98.71 | 98.71 | 98.91 | 99.23 | 100.23 | 101.04 | 101.31 | 101.58 | 101.91 | 150 |

The measurements have been carried out with 1 kΩ resistors in the emitters of $T_1$ and $D_2$.

The invention is not limited to the embodiments described in the foregoing. For example, the Zener diode mentioned above may be replaced by a diode poled in the reverse direction or by a plurality of diodes arranged in series and poled in the reverse direction. This simply results in the modes of operation described above being defined less sharply.

What is claimed is:

1. A current mirror which comprises: a first branch for receiving an input current to be reproduced and comprising a series arrangement of a first diode poled in the forward direction and the main current path of a first transistor whose emitter is connected to a common-mode terminal, and a second branch for supplying an output current which is a replica of said input current and comprising a series arrangement of the main current path of a second transistor and a second diode which is poled in the foward direction and which has a first electrode connected to the base of the first transistor and to the emitter of the second transistor and which has a second electrode connected to the common-mode terminal, characterized in that the first branch comprises a third diode connected in series and poled in the forward direction and having a first electrode for receiving the input current to be reproduced, in that the second branch comprises the main current path of a third transistor whose emitter is connected to the collector of the second transistor and whose collector supplies the output current, and a further diode poled in the reverse direction between the base of the third transistor and the emitter of the second transistor, a fourth diode, poled in the forward direction and having a first electrode connected to a power-supply terminal and a second electrode connected to the base of the third transistor, and a fourth transistor whose base is connected to the first electrode of the third diode, whose collector is connected to said power-supply terminal, and whose emitter is connected to the base of the second transistor.

2. A current mirror as claimed in claim 1, characterized in that the further diode is a Zener diode.

* * * * *